US006879237B1

(12) United States Patent
Viarouge et al.

(10) Patent No.: US 6,879,237 B1
(45) Date of Patent: Apr. 12, 2005

(54) POWER TRANSFORMERS AND POWER INDUCTORS FOR LOW-FREQUENCY APPLICATIONS USING ISOTROPIC MATERIAL WITH HIGH POWER-TO-WEIGHT RATIO

(75) Inventors: Philippe Viarouge, Sainte-Foy (CA); Jérôme Cros, Ste Foy (CA)

(73) Assignee: Electrotechnologies Selem Inc., Quebec (CA)

( * ) Notice: Subject to any disclaimer, the term of this patent is extended or adjusted under 35 U.S.C. 154(b) by 0 days.

(21) Appl. No.: 10/070,750

(22) PCT Filed: Sep. 14, 2000

(86) PCT No.: PCT/CA00/01076

§ 371 (c)(1),
(2), (4) Date: Jul. 19, 2002

(87) PCT Pub. No.: WO01/20622

PCT Pub. Date: Mar. 22, 2001

(30) Foreign Application Priority Data

Sep. 16, 1999 (CA) ..... 2282636

(51) Int. Cl.[7] ..... H01F 27/24
(52) U.S. Cl. ..... 336/229; 336/55; 336/212
(58) Field of Search ..... 336/229, 55, 212, 336/234; 148/304, 301, 302, 306

(56) References Cited

U.S. PATENT DOCUMENTS

| | | | | |
|---|---|---|---|---|
| 1,606,777 | A | 11/1926 | Payne | 336/83 |
| 3,668,589 | A | 6/1972 | Wilkinson | 336/212 |
| 3,968,465 | A | 7/1976 | Fukui et al. | 336/110 |
| 4,138,783 | A | 2/1979 | Portier | 29/606 |
| 4,201,837 | A | 5/1980 | Lupinski | 428/457 |
| 4,507,640 | A | 3/1985 | Rich, III et al. | 336/223 |
| 4,601,765 | A | 7/1986 | Soileau et al. | 148/104 |

(Continued)

FOREIGN PATENT DOCUMENTS

| | | |
|---|---|---|
| CH | 113444 | 1/1926 |
| DE | 1003293 | 2/1957 |
| EP | 64846 | 11/1982 |
| EP | 557549 | 9/1993 |
| FR | 65141 | 1/1956 |
| FR | 1281532 | 5/1962 |
| GB | 655414 | 7/1951 |
| JP | 408222442 A * | 8/1996 |

OTHER PUBLICATIONS

I.C. Gelinas, L.P. Lefebvre, S. Pelletier, and P. Viarouge, Effect of Temperature on Properties of Iron–Resin Composites for Automotive Applications, SAE Technical Paper 970421 Eng. Soc. For Advancing Mobility Land Sea Air and Space. Int. Congress Detroit Michigan Feb. 24–27, 1997.

J. Lundquist, "Field Measurements of Harmonic Distortion and the Role of the DC–Link Inductor," Proceedings of 8th International Conference on Harmonics and Quality of Power, Oct. 14–16, 1998, vol. 2, pp. 1119–1124.

(Continued)

*Primary Examiner*—Anh Mai
(74) *Attorney, Agent, or Firm*—Fitzpatrick, Cella, Harper & Scinto

(57) ABSTRACT

A transformer for low frequency applications of from 50 Hz to 1000 Hz is described. The transformer comprises a core having a cylindrical symmetry around a main revolution axis. The core is formed of a soft isotropic magnetic composite material composed of iron and resin. Windings are enclosed in the magnetic core and disposed about a central column of the magnetic core and magnetically coupled with the inductor for low frequency applications, DC to 1000 Hz of similar construction is also described, the inductor comprises a core having a cylindrical symmetry around a main revolution axis. The core is formed of a soft isotropic magnetic composite material composed of iron and resin. Winding is enclosed in the magnetic core and disposed about a central column of the magnetic core and magnetically coupled with the magnetic core. The core is formed by core sections.

35 Claims, 6 Drawing Sheets

U.S. PATENT DOCUMENTS

| | | | | |
|---|---|---|---|---|
| 4,602,957 | A | 7/1986 | Pollock et al. | 75/246 |
| 4,808,326 | A | 2/1989 | Tanino et al. | 252/62.54 |
| 4,820,338 | A | 4/1989 | Ochiai et al. | 75/233 |
| 4,891,558 | A | 1/1990 | Tschuk | 315/62 |
| 5,058,655 | A | * 10/1991 | Derp et al. | 164/128 |
| 5,175,525 | A | 12/1992 | Smith | 251/83 |
| 5,198,137 | A | 3/1993 | Rutz et al. | 252/62.54 |
| 5,198,138 | A | 3/1993 | Yamamoto et al. | 252/62.54 |
| 5,296,051 | A | 3/1994 | Inokuti et al. | 148/113 |
| 5,510,412 | A | 4/1996 | Suzuki et al. | 524/440 |
| 5,544,410 | A | 8/1996 | Kato et al. | 29/605 |
| 5,591,373 | A | 1/1997 | Ward et al. | 252/62.54 |
| 5,637,402 | A | 6/1997 | Gay | 428/403 |
| 5,748,013 | A | 5/1998 | Beauclair et al. | 336/233 |
| 5,755,986 | A | 5/1998 | Yamamoto et al. | 252/62.54 |
| 5,771,013 | A | 6/1998 | Fey | 342/4 |
| 5,932,134 | A | 8/1999 | Christ et al. | 252/62.54 |
| 6,202,738 | B1 * | 3/2001 | Tanaka et al. | 165/80.3 |

OTHER PUBLICATIONS

M.M. Jovanovic et al., "Merits and Limitations of Full–Bridge Rectifier with LC Filter in M eting IEC 1000–3–2 Harmonic–Limit Specifications," Eleventh Annual Applied Power Electronics Conference and Exposition, APEC '96 Conference Proceedings, Mar. 3–7, 1996, vol. 1, pp. 354–360.

* cited by examiner

POWER TRANSFORMERS AND POWER INDUCTORS FOR LOW-FREQUENCY APPLICATIONS USING ISOTROPIC MATERIAL WITH HIGH POWER-TO-WEIGHT RATIO

CROSS REFERENCE TO RELATED APPLICATIONS

This application is a National Stage filing under 35 U.S.C. § 371 of International Application No, PCT/CA00/01076, filed Sep. 14, 2000, which in turn claims priority of Canadian Application No. 2,282,636, filed Sep. 16, 1999, the priority of both of which are claimed. International Application PCT/CA00/01076 was published in English as International Publication No. WO 01/20622 A1 on Mar. 22, 2001.

FIELD OF THE INVENTION

The present description presents several structures of transformers and inductors one of which is shown in FIGS. 1*a* and 1*b* using a core 10 which has a cylindrical symmetry (see FIG. 1*c*) around one main revolution axis 11, with windings 12 only one winding in the inductor case, enclosed in the magnetic core 10. The primary winding 12 of these transformers and/or autotransformers is directly connected to an AC power supply 13 (see FIG. 12) with an operation frequency in the range of 50 Hz to 1000 Hz. The power range of these applications lies between 1 VA and 10 kVA. The materials used for the realization of the magnetic cores 10 of these devices are isotropic soft magnetic composite materials, made of iron powder and resin.

The proposed structures are maximizing the power to weight ration of the devices. These devices can be used alone or in association with rectifiers 14 which use diodes and/or thyristors and/or transistors to provide the power supply which is used in equipment having electronic components circuits. The devices can also be used to construct distribution transformers, isolation transformers and inductors with or without low profile.

BACKGROUND OF THE INVENTION

Since the end of the $19^{th}$ century, laminated soft magnetic materials have been used for the construction of single or polyphase transformers and inductors for applications in the usual commercial range of AC supply frequency (from 50 Hz to 1000 Hz) for a wide power range (from 1 VA to several kVA). These isolated laminations present interesting magnetic properties with a high level of induction of saturation (near 1.8 T). The isolation of the laminations also allows the minimization of the magnetic losses because the magnetic flux is circulating in the plane of the laminations (the flux is circulating in two dimensions only). The shapes of the magnetic core are then imposed by this constraint and limited to a toroïd shape, and E, C or I-shape (E-core, C-core or I-core) and all combinations of these topologies.

The cost of the assembly of these devices is relatively high, because the production process needs an important number of steps including lamination forming, punching, mounting and stacking, insertion of the winding and isolation, mounting of the external support and the terminal plate. These transformers are commercially available in standard sizes to cover a wide power range.

One drawback of the lamination use is the generation of an important audible noise for the usual values of frequency of the AC supply systems in the range from 50 Hz to 1000 Hz (50, 60 or 400 Hz for example) see U.S. Pat. No. 529,051 to Inokuti; Yukio et al. "Method of producing low iron loss grain oriented steel having low noise and superior shape characteristics". The electrical insulation between laminations also reduces in great proportions, the heat transfer between the laminations, and the main part of the heat is circulating in the plane of the laminations, i.e. in two dimensions only. The contribution of the magnetic core for the transfer of the heat generated by the copper losses in the windings and the magnetic losses in the core to the ambiance is therefore limited. In such structures using laminations, the temperature rise between the windings and the laminations remains an important limitation in terms of power to weight ratio.

The variations of the permeability of the magnetic materials used in laminations are very important when saturation is occurring. It is then necessary to oversize the transformers and inductors to avoid saturation in the case of voltage variations of the AC supply. When saturation occurs, the magnetizing current can increase in great proportions and produce an excessive heating of the windings.

The conventional shapes of magnetic cores like E, C and I-configuration cores do not maximize the power to volume and power to weight ratios of the transformers and inductors. In these structures, there are also important magnetic stray fields and leakage flux which circulate in the external environment of the device and can induce parasitic perturbations in electrical or electronic circuits, for example. In applications where the stray magnetic radiation of the transformer or the inductor must be eliminated, magnetic cores with a toroïdal shape are generally used (transformers used in power supplies of audio amplifiers for example) see U.S. Pat. No. 3,668,589 by Wilkinson "Low frequency magnetic core inductor structure". But the winding process on such a core is difficult and the transfer of the heat generated by copper losses in the windings and magnetic losses in the core to the ambiance, in such transformers and inductors, is not efficient.

The magnetic cores which present a cylindrical symmetry around one main revolution axis with windings enclosed are the best suitable for the realization of transformers and inductors. In such structures, there is an optimal use of the copper volume and a good magnetic coupling between the windings. The power to weight ratio and the power to volume ratio are maximized. But it is impossible to realize this shape of magnetic core with laminations, because in the cores which present a cylindrical symmetry around one main revolution axis with windings enclosed, the magnetic flux is circulating in the three dimensions. It is necessary to use an isotropic soft magnetic material with a low electrical conductivity.

Since 30 years, magnetic cores which present a cylindrical symmetry (Pot-cores for example) have been realized with isotropic sintered soft magnetic materials with low electrical conductivity like ferrites for high frequency power supplies (20 kHz to 300 kHz) see U.S. Pat. No. 4,602,957 to Pollock et al, "Magnetic powder compacts". The magnetic and thermal properties of these materials are isotropic and their magnetic losses are minimized on a wide range of frequency up to 500 kHz and several Mhz see U.S. Pat. No. 4,507,640 to Rich III et al, "High frequency transformer". Several distributors, such as Philips, Siemens, etc, are already offering a wide range of standard size ferrite cores with different shapes C, E and I-cores, toroïd cores, ETD-cores and Pot-cores, to realize high frequency transformers and inductors. But, at low frequency, the power to weight ratio of the transformers and inductors is also proportional to the value of the induction of saturation of the soft magnetic material.

The induction of saturation of the ferrite material which is relatively low, near 0.4 T, is limiting the use of such a material for applications at low values of frequency used in the conventional AC supplies systems, from 50 Hz to 1000 Hz, for example 50 Hz, 60 Hz and 400 Hz. The use of ferrite materials is then limited to high frequency applications. Because they are sintered, the ferrite materials are also brittle and the size and shape of the cores which can be realized are therefore limited. For example, because these materials are brittle, it is not possible to press cooling fins directly on the cores during forming.

Other kinds of magnetic materials have been proposed for the realization of Pot-Core transformers for low or high frequency applications as disclosed in U.S. Pat. Nos. 4,601,765 to Soileau et al and 4,201,837 to Lupinski. Generally the sintered materials present a high cost of production and the cores which are proposed don't have cooling fins on their external surface to maximize the power to weight ratio.

Several new soft magnetic composites have been recently developed in the domain of powder metallurgy. (ATOMET EM-1 of Quebec Metal Powders Inc for example, see I C. Gélinas, L. P. Lefebvre, s. Pelletier, P. Viarouge, Effect of Temperature on Properties of Iron-Resin Composites for Automative Applications, SAE Technical Paper (7p.) 970421 Eng. Soc. for Advancing Mobility Land Sea Air and Space. Int. Congress Detroit Mich. Feb. 24–27, 1997. In such soft magnetic isotropic materials, the iron flakes are isolated from each other by a resin coating. These materials need a pressing process and a thermal treatment at low temperature. Their cost of production is then reduced. These materials are more adapted to applications where a mass production is necessary, despite the fact that their production cost per kilogram remains higher than the one of laminations (near two times higher).

By using a molding technique, it is possible to realize a core of complex shape in a single operation. It is also possible to machine the soft magnetic composites with conventional tools, while the sintered materials like soft magnetic ferrite can be only rectified with diamond grinding wheels.

The use of the soft magnetic composites for applications in the low frequency domain from 50 Hz to 1000 Hz is not still developed because these materials present a relatively low value of permeability when compared to the value of the permeability of laminations (the relative permeability of the soft magnetic composites is near 200 and 1500 for the conventional grades of laminations).

The magnetic losses at 50 Hz and 60 Hz in the soft magnetic composites are higher than in the soft magnetic laminated materials. (near 5 to 15 W/kg at 1.2 T instead of 2 W/kg for the soft magnetic laminated materials). But at 400 Hz, the magnetic losses of some soft magnetic composites can be 2 times lower see the above-referred technical paper.

DISCLOSURE OF INVENTION

We have found that despite the fact that soft magnetic composite materials do not present, at first sight, interesting magnetic characteristics for the realization of transformers (relative permeability near 120 at 1.2 T), the use of magnetic cores made of isotropic soft magnetic composite material with a structure presenting a cylindrical symmetry around one main revolution axis with windings enclosed, can be used to increase the power to weight and power to volume ratios when compared to the transformers using a conventional core structure made of laminations.

If the core structure presenting a cylindrical symmetry around one main revolution axis with windings enclosed is equipped with integrated cooling fins made of the soft magnetic composite material itself, it is possible to increase the power to weight ratio, because the external surface of dissipation of the core and the transfer of the heat generated by the copper and magnetic losses to the ambiance are increased. In the present invention, we propose to directly form these cooling fins with the soft magnetic composite material itself because the mechanical properties of such materials allow this kind of realization during the pressing process. These cooling fins do not need any other fabrication step because they are pressed directly with the core itself. But it is also possible to realize them by machine finishing (machining) of the core after the pressing process. These kinds of cooling fins are also more efficient in terms of heat transfer when compared to conventional aluminum fins which can be attached to the magnetic core, because there no contact thermal resistance between the magnetic structure and the fins.

It is pointed out that the thermal conductivity of the soft magnetic composite materials is similar to the thermal conductivity of iron. But the thermal properties of the soft magnetic composite materials are also isotropic, and the thermal conductivity presents the same value in the three dimensions. Consequently, the temperature rise of the winding above the ambiance remains low, and it is thus possible to achieve designs with a further reduction of the total mass of the device. The magnetic flux can also circulate in the cooling fins which are a part of the magnetic core, if the fins are adequately oriented in the direction of the circulation of the flux. The cooling fins are then magnetically active and a further reduction of the total amount of material is obtained. This advantage is important for the realization of single phase transformers up to 10 kVA.

The absence of audible noise is also an important advantage of cores used in AC applications which are realized with a soft magnetic composite material. The elimination of external stray magnetic fields a still further important advantage of the cores used in AC systems which present a cylindrical symmetry.

SUMMARY OF THE INVENTION

According to a broad aspect of the present invention there is provided a transformer for low frequency applications from 50 Hz to 1000 Hz. The transformer comprises a core having a cylindrical symmetry around a main revolution axis. The core is formed of a soft isotropic magnetic composite material composed of iron and resin. Windings are enclosed in the magnetic core and disposed about a central column of the magnetic core and magnetically coupled with the magnetic core. The core is formed by core sections.

According to a still further broad aspect of the present invention there is provided an inductor for low frequency applications, DC to 1000 Hz. The inductor comprises a core having a cylindrical symmetry around the main revolution axis. The core is formed of a soft isotropic magnetic composite material composed of iron and resin. A winding is enclosed in the magnetic core and disposed about a central column of the magnetic core and magnetically coupled with the magnetic core. The core is formed by core sections.

BRIEF DESCRIPTION OF THE DRAWINGS

A preferred embodiment of the present invention will now be described with reference to the accompanying drawings in which.

DESCRIPTION OF PREFERRED EMBODIMENTS

Figure 1C:
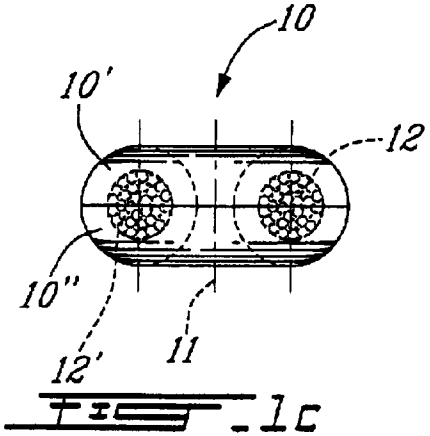
FIG. 1*c* is a side view of an assembly of two core sections of FIGS. 1*a* and 1*b;*
Figure 1B:
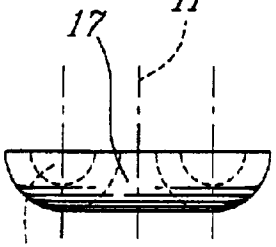
FIG. 1*b* is a side view of FIG. 1*a;*
Figure 1A:
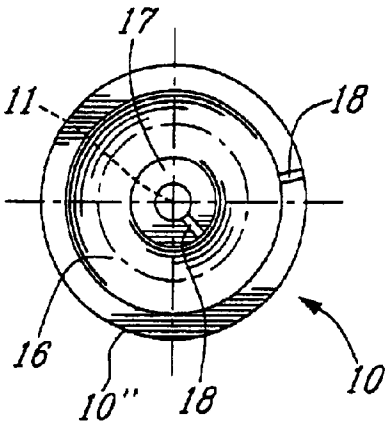
FIG. 1*a* is a top view of a section of a magnetic core constructed in accordance with the present invention and having a cylindrical symmetry around one main revolution axis and a circular cross-section of the winding window and the magnetic core.

The present description presents several structures of transformers and inductors one of which is shown in FIGS. 1*a* and 1*b* using a core 10 which has a cylindrical symmetry (see FIG. 1*c*) around one main revolution axis 11, with windings 12 only one winding in the inductor case, enclosed in the magnetic core 10. The primary winding 12 of these transformers and/or autotransformers is directly connected to an AC power supply 13 (see FIG. 12) with an operation frequency in the range of 50 Hz to 1000 Hz. The power range of these applications lies between 1 VA and 10 kVA. The materials used for the realization of the magnetic cores 10 of these devices are isotropic soft magnetic composite materials, made of iron powder and resin.

The proposed structures are maximizing the power to weight ration of the devices. These devices can be used alone or in association with rectifiers 14 which use diodes and/or thyristors and/or transistors to provide the power supply which is used in equipment having electronic components circuits. The devices can also be used to construct distribution transformers, isolation transformers and inductors with or without low profile.

The cores 10 are realized by a machining or pressing process of an isotropic soft magnetic composite material composed of iron and resin.

With the solutions which are presented, it is possible to produce transformers 15 and inductors 16 (see FIG. 12) with a power to weight ratio which is higher than in the case of the classical structures of transformers and inductors which use laminations.

Figure 4A:
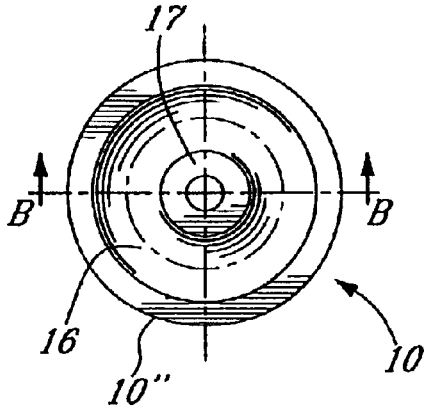
FIG. 4*a* is a top section view of the magnetic core as seen along section lines A—A of FIG. 4*b*, presenting a cylindrical symmetry around one main revolution axis and a rectangular cross-section, with round corners, of the winding window and end of magnetic core.
Figure 4B:
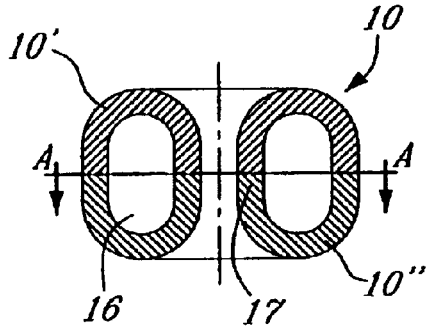
FIG. 4*b* is a section view along section lines B—B of FIG. 4*a;*

Referring to FIGS. 1*a* to 4*b* it can be seen that the shapes of the structures which are proposed in this invention present a cylindrical symmetry around one main revolution axis 11, and the winding or the windings 12, 12' are enclosed in the magnetic core 10. In the plane of the cylindrical symmetry (a plane passing through the revolution axis), the cross-section of the winding window 16 and the magnetic core 10 can be rectangular (FIG. 5*b*), circular (FIG. 3*b*) or oval (FIG. 4*b*). With such an arrangement, it is possible to get a good coupling between the windings 12, and to minimize the external stray magnetic fields, because the shielding effect of the magnetic core 10. The audible noise is also eliminated because a soft magnetic composite material is used.

The magnetic core 10 is realized in two identical parts or sections 10' and 10", to simplify the production process and the windings 12 and 12' are placed around the central column 17 of the magnetic core. One or two holes 18 with a small diameter can be realized in the base or on one side of the two sections of the core 10 to connect the output wires of the internal winding or windings to the external output terminals (not shown) of the transformer or inductor.

Figure 2B:
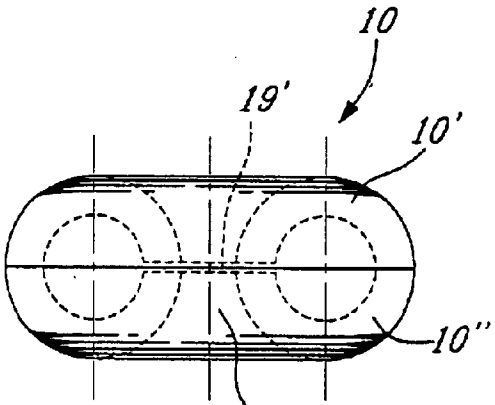
FIG. 2*b* is another side view showing an air gap at the center of the core.

The magnetic core 10 of an inductor can present an airgap 19 realized by separating its two sections 10' and 10" (FIG. 2*a*) or by using a central column and an external shell of different lengths (FIG. 2*b*). In this case, it is preferable to make an airgap 19' on the central column 17 to minimize the external magnetic stray fields. It is also possible to increase the central airgap to eliminate the central column.

The shapes of the cross-section of the winding window 16 and the core in the plane of the cylindrical symmetry, a plane passing through the revolution axis 11, can be different.

Figure 5A:
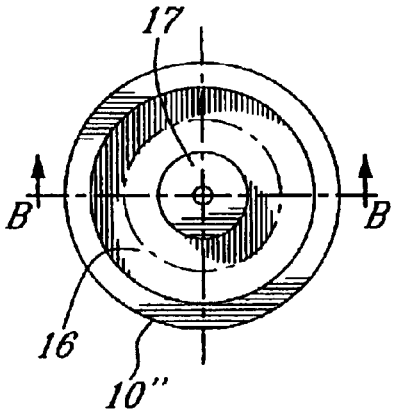
FIG. 5*a* is a top view along section lines A—A of FIG. 5*b* showing the magnetic core presenting a cylindrical symmetry around one main revolution axis and a rectangular cross-section of the winding window and the magnetic core.
Figure 5B:
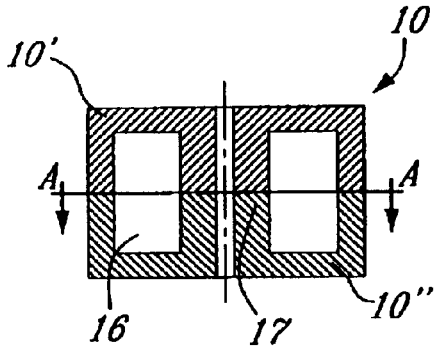
FIG. 5*b* is a section view along section lines B—B of FIG. 5*a;*

With a circular cross-section as shown in FIGS. 1*a* to 1*c*, it is possible to minimize the total amount of magnetic material and to reduce the iron losses, because the repartition of the flux lines is homogeneous and there is no local saturation like in the corners of the window of the structure with a rectangular cross-section as shown in FIGS. 5*a* and 5*b*.

It is also possible to use an oval cross-section or a rectangular cross-section with round corners FIG. 4*b*). This structure of core is more adapted to the pressing process of the soft magnetic composites than the structure of FIGS. 5*a* and 5*b*, and it presents the same advantages.

Figure 6A:
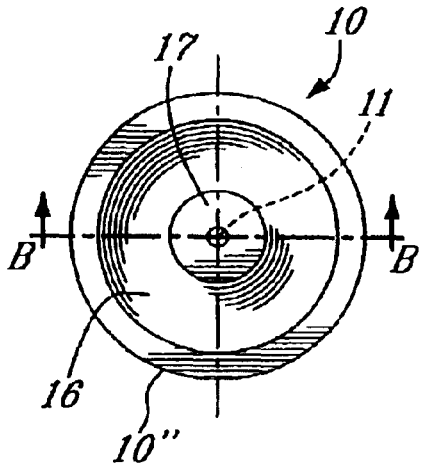
FIG. 6*a* is a top section view along section lines A—A of FIG. 6*b* illustrating the magnetic core presenting a cylindrical symmetry around one main revolution axis, a rectangular outer cross section of the core and a trapezoidal cross section of the winding window.
Figure 6B:
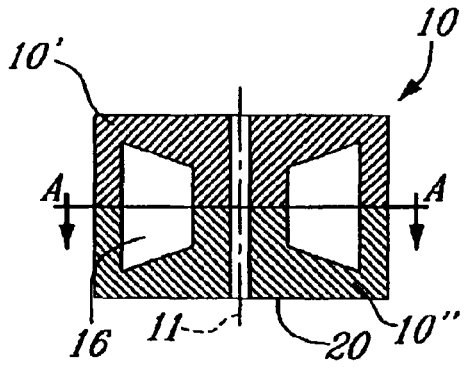
FIG. 6*b* is a section view along section lines B—B of FIG. 6*a;*
Figure 7A:
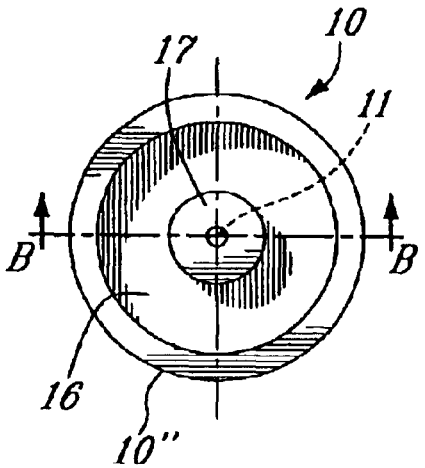
FIG. 7*a* is a top section along section lines A—A FIG. 7*b* illustrating the magnetic core presenting a cylindrical symmetry around one main revolution axis, a trapezoidal outer cross-section of the core and a rectangular cross-section of the winding window.
Figure 7B:
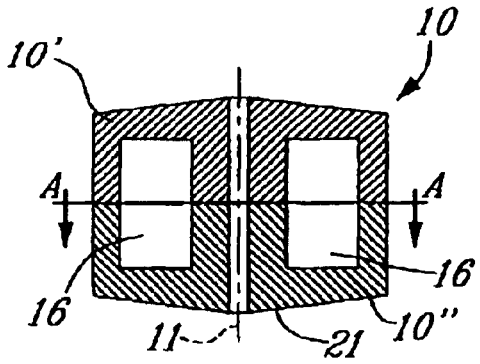
FIG. 7*b* is a section view along section lines B—B of FIG. 7*a;*
Figure 10A:
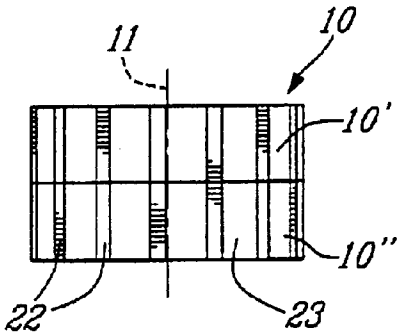
FIGS. 10*a* and 10*b* are side and top views respectively of a core constructed in accordance with the embodiment of FIG. 5*b* but with fins extending about the side wall of the core.
Figure 10B:
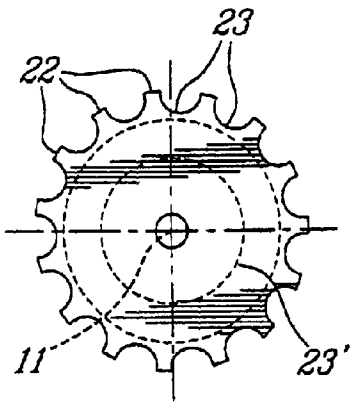
Figure 9A:
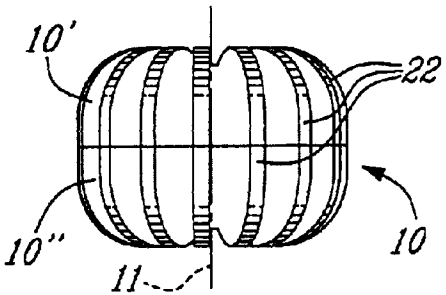
FIGS. 9*a* and 9*b* are side and top views respectively showing a core constructed in accordance with the embodiment of FIG. 4*b* but with fins provided about the core.
Figure 9B:
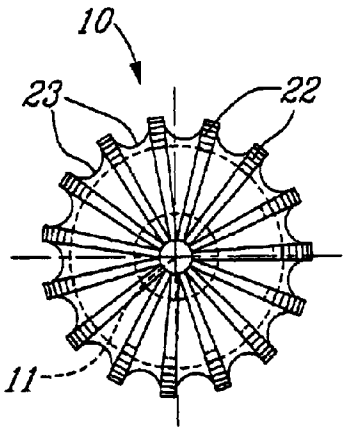
Figure 8A:
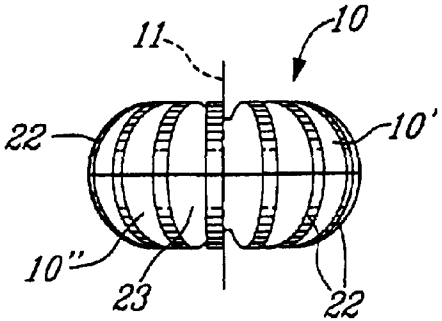
FIGS. 8*a* and 8*b* are side and top views of a magnetic core constructed in accordance with the design of FIG. 1*c* but with the core provided with fins.
Figure 8B:
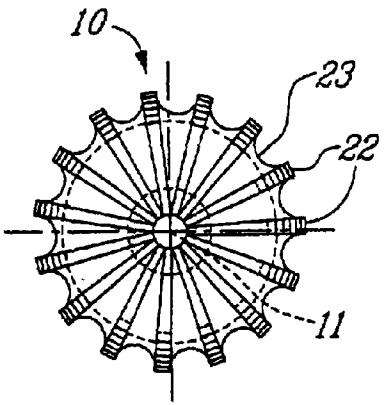
Figure 11A:
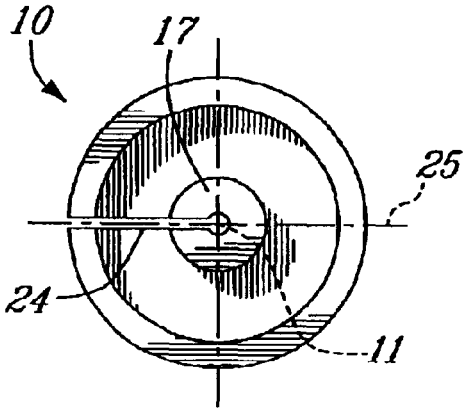
FIG. 11*a* is a top section view along section lines AA of the core as shown in FIG. 11*b* illustrating a slot formed in each of the core sections.
Figure 11B:
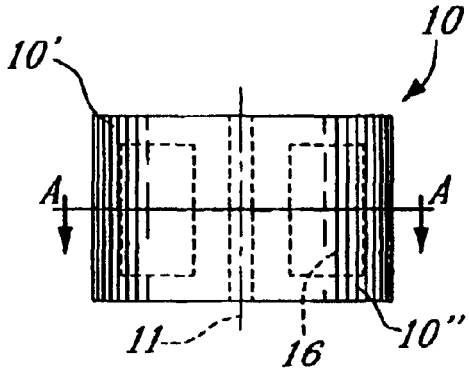
FIG. 11*b* is a side view of FIG. 11*a;*
Figure 11C:
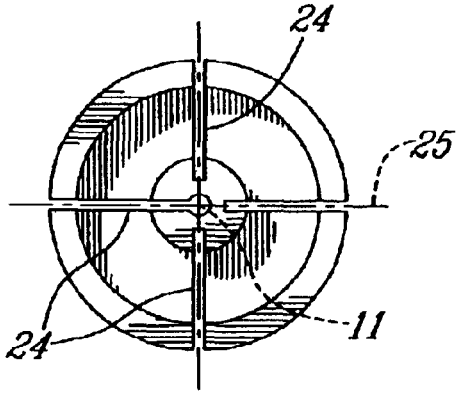
FIG. 11*c* is a further top section view along section lines AA of FIG. 11*b* showing a plurality of slots formed in the core for reducing the circulation of Eddy currents therein.
Figure 11D:
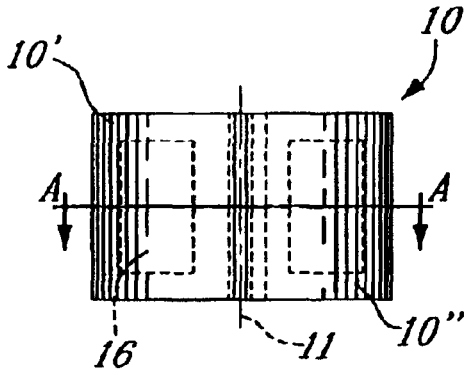
FIG. 11*d* is a side view of the core of FIG. 11*c*.

It is also possible to use a trapezoidal cross-section of the winding window with a rectangular external cross-section 20 of the core as shown if FIG. 6*b*, or a rectangular cross-section of the winding window 16 with a trapezoidal external cross-section 21 of the core as shown in FIG. 7*b*. These structures of core are minimizing the total amount of magnetic material but not so perfectly than the structure of FIGS. 1*a* to 1*c*.

All the proposed cores 10 of FIGS. 1*a* to 7*b* can be realized with different values of form factor (ratio between the height and the external diameter of the core) to be adapted to specific constraints of the applications. Low profile transformers or inductors can be easily realized with a low cost of production because the use of soft magnetic iron-resin composites. For example low profile inductors and transformers are well adapted to the implementation on electronic cards in racks with a limited interval between cards as discussed in U.S. Pat. No. 5,175,525.

With reference to FIGS. 8*a* to 10*b* and in order to optimize the heat transfer and to maximize the power to weight ratio of the transformer or the inductor, it is preferable to add cooling fins 22 on the core 10. The particular solution presented in this invention consists in the direct realization of the cooling fins 22 on the external surface 23 of the device by using the soft magnetic material itself. These cooling fins 22 are integrally formed in the structure of the core 10 and consequently they are realized in a single operation during the pressing process. The thermal conductivity of the soft magnetic composite material is high and the heat transfer from the winding 12 or the windings 12 and 12' and the core 10 to the ambiance is efficient. It is also possible to maximize the use of the magnetic material of the cooling fins to let circulate the magnetic flux in them. With such an arrangement, the volume of soft magnetic material is still reduced. In this case the fins 22 must be oriented in the direction of the magnetic flux circulation. The fins 22 can be realized on the whole external surface of the core 10 or on one part of this surface only, see for example the structure of FIGS. 10*a* and 10*b*. It is represented with no fins on the horizontal surfaces 23', but it is also possible to put fins on these surfaces 23'. One can note in the structures of cores 10 presented in this invention that the optimal directions of fin orientations are always in the planes of the cylindrical symmetry, a plane passing through the revolution axis 11. The use of such cooling fins 22 allows an increasing improvement of the power to weight ratio proportional to the power of the device.

Referring now to FIGS. 11*a* to 11*d*, it is pointed out that when the electrical conductivity of the soft magnetic composite material which is used is relatively high, it is necessary to realize one or several slots 24 with a small thickness to reduce the circulation of eddy currents in the core and to minimize the magnetic losses. One can note that the planes 25 of the slots 24 must be planes of the cylindrical symmetry, planes passing through the revolution axis 11.

The classical structures of three-phase transformers and inductors with three columns are realized with E cores. There are one or several windings on each column which correspond to one phase of the three phase power supply. With the three column structure, the phase windings are magnetically coupled. Three-phase transformers and inductors can be realized by using three different cores (one core per phase) with the structures described in this invention. With such an arrangement, the phase windings can be magnetically isolated if the cores are separated from each other by airgaps, or magnetically coupled if the cores are directly stacked on each other. It is also possible to place the individual cores with a spatial phase displacement of 120 deg. To obtain a symmetrical coupling of the phase windings.

Figure 2A:
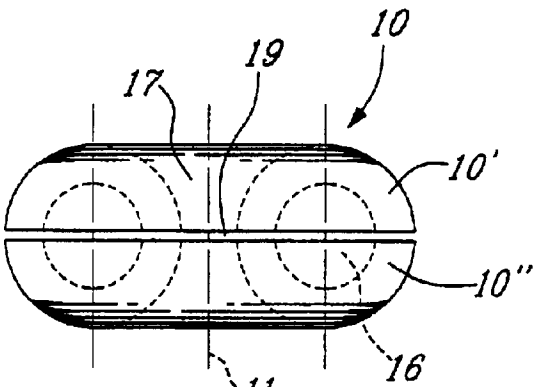
FIG. 2*a* is a side view of the magnetic circuit for an inductor application showing an air gap between the two sections of the core.
Figure 3A:
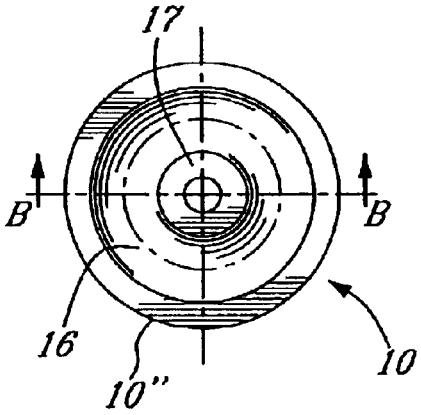
FIG. 3*a* is a top view along section lines A–A' of FIG. 3*b*, presenting a core with a cylindrical symmetry around one main revolution axis and a circular cross-section of the winding window and the magnetic core.
Figure 3B:
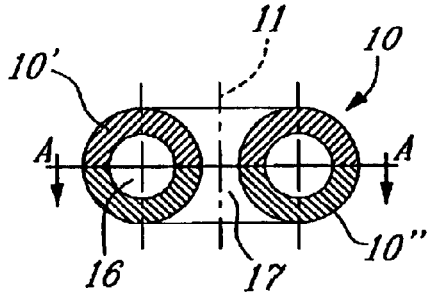
FIG. 3*b* is a section view along section line B—B of FIG. 3*a;*

Single phase inductors with distributed airgaps can also be realized by stacking several cores with the shape of the core of FIGS. 2*a* or 2*b* which possess an airgap 19 and 19' of small width. Because each core 10 is possessing a small airgap 19, the copper losses generated by proximity effect in the winding regions 16 near the airgaps 19 is reduced.

Figure 12:
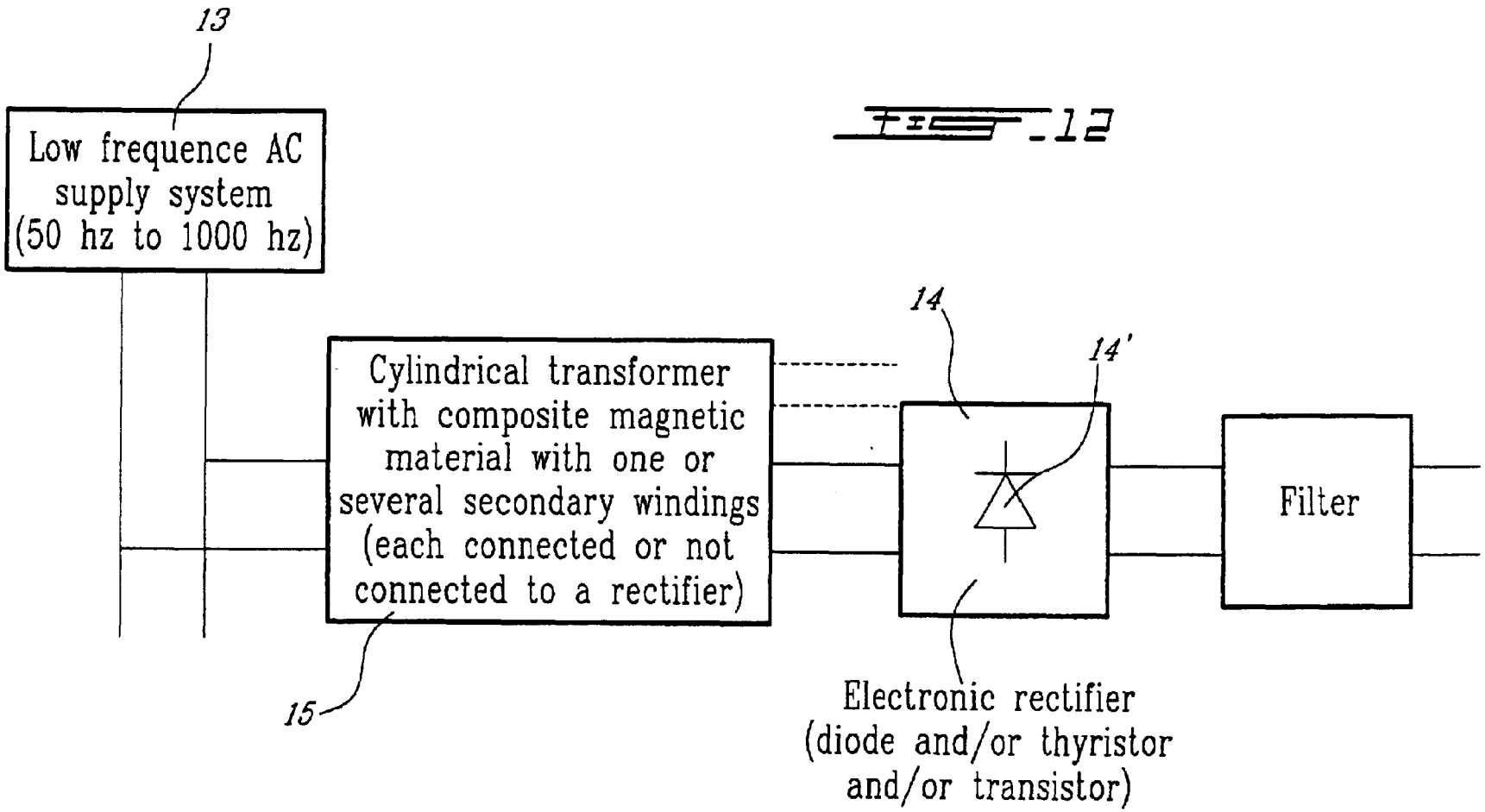
FIG. 12 is block diagram showing an application of the transformer with one or several secondary windings and connected to a rectifier circuit and for use as a DC supply for electronic components.

When a transformer is realized in accordance with the present invention and a soft magnetic composite material in association with one or several rectifiers 14 using diodes 14' and/or thyristors and/or transistors, see FIG. 12; the standard IEC-555-2 on the injection of current harmonics in the AC power supply is satisfied, because the harmonic content of the magnetizing current and its amplitude are relatively low.

It is within the ambit of the present invention to cover any obvious modifications of the preferred embodiment described herein, provided such modifications fall within the scope of the appended claims.

What is claimed is:

1. A transformer for low frequency applications of from 50 Hz to 1000 Hz, said transformer comprising:

a core having a cylindrical symmetry around a main revolution axis, said core being formed of a soft isotropic magnetic material comprised of iron, said core including integral cooling fins comprising the soft isotropic magnetic material projecting from an external surface of said core; and windings enclosed in said core and magnetically coupled with said core.

2. The transformer as claimed in claim 1 wherein said core is formed by core sections.

3. The transformer as claimed in claim 1 wherein said fins are integrally formed with said core during pressing of said core in a single operation process.

4. The transformer as claimed in claim 1 wherein said fins are machined in said core in a machining operation.

5. The transformer as claimed in claim 1 wherein said fins are oriented in a direction of magnetic flux circulation of said core and in planes of said cylindrical symmetry passing through said revolution axis.

6. The transformer as claimed in claim 1 wherein said core defines a winding window having a circular cross-section in a plane of said cylindrical symmetry passing through said revolution axis.

7. The transformer as claimed in claim 1 wherein said core defines a winding window having an oval cross-section in a plane of said cylindrical symmetry passing through said revolution axis.

8. The transformer as claimed in claim 1 wherein said core defines a winding window having a rectangular cross-section, with or without round corners in a plane of said cylindrical symmetry passing through said revolution axis.

9. The transformer as claimed in claim 1 wherein said core defines a winding window having a trapezoidal cross-section, with or without round corners in a plane of said cylindrical symmetry passing through said revolution axis.

10. The transformer as claimed in claim 1 wherein said core is provided with one or more slots placed in planes of said cylindrical symmetry passing through said revolution axis to reduce eddy currents.

11. The transformer as claimed in claim 1, further comprising:

a primary winding to connect said transformer directly to an AC power supply having a frequency in a range of 50 Hz to 1000 Hz; and one or more secondary windings connected to a rectifier using diodes and/or thyristors and/or transistors.

12. The transformer as claimed in claim 1, characterized in that said transformer has a low level of audible noise when supplied with AC currents at low frequencies in a range of 50 Hz to 1000 Hz, and substantially no magnetically induced vibrations in said magnetic material thereby minimizing audible noise.

13. The transformer as claimed in claim 1, said transformer having a low level of electromagnetic interference (EMI) and a low external stray magnetic field.

14. The transformer as claimed in claim 1, characterized in that when said transformer is connected to an AC power supply having a frequency of from 50 Hz to 1000 Hz, input currents present a low total harmonic distortion (THD).

15. The transformer as claimed in claim 1, characterized in that said transformer has small values of form factor (ratio between a height along said revolution axis and an external diameter of said core) when adapted to specific constraints of low profile applications.

16. An inductor for low frequency applications, DC to 1000 Hz, said inductor comprising:

a core having a cylindrical symmetry around a main revolution axis, said core being formed of a soft isotropic magnetic material comprised of iron, said core including integral cooling fins comprising the soft isotropic magnetic material projecting from an external surface of said core; and a winding enclosed in said core and disposed about a central column of said core and magnetically coupled with the said core.

17. The inductor as claimed in claim 16 wherein said magnetic core is provided with one or more airgaps, said core has two core sections, and said airgaps are formed by separating said two sections or by using a central column and an external shell of different lengths.

18. The inductor as claimed in claim 16 wherein said core is formed by core sections.

19. The inductor as claimed in claim 16 wherein said fins are integrally formed with said core during pressing of said core in a single operation process.

20. The inductor as claimed in claim 16 wherein said fins are machined in said core in a machining operation.

21. The inductor as claimed in claim 16 wherein said fins are oriented in a direction of magnetic flux circulation of said core and in planes of said cylindrical symmetry passing through said revolution axis.

22. The inductor as claimed in claim 16 wherein said core defines a winding window having a circular cross-section in a plane of said cylindrical symmetry passing through said revolution axis.

23. The inductor as claimed in claim 16 wherein said core defines a winding window having an oval cross-section in a plane of said cylindrical symmetry passing through said revolution axis.

24. The inductor as claimed in claim 16 wherein said core defines a winding window having a rectangular cross-section with or without round corners in a plane of said cylindrical symmetry passing through said revolution axis.

25. The inductor as claimed in claim 16 wherein said core defines a winding window having a trapezoidal cross-section, with or without round corners in a plane of said cylindrical symmetry passing through said revolution axis.

26. The inductor as claimed in claim 16 wherein said core is provided with one or more slots placed in planes of said cylindrical symmetry passing through said revolution axis to reduce eddy currents.

27. The inductor as claimed in claim 16, characterized by said inductor having a low level of audible noise when supplied with AC currents at low frequencies in a range of 50 Hz to 1000 Hz and having substantially no magnetically induced vibrations in said soft magnetic material.

28. The inductor as claimed in claim 16, characterized in that when said inductor is connected to an AC power supply having a frequency of from 50 Hz to 1000 Hz, input currents present a low total harmonic distortion (THD).

29. The inductor as claimed in claim 16, characterized in that copper losses generated by a proximity effect in said winding are minimized when several individual inductors which possess an airgap of small width are stacked.

30. The inductor as claimed in claim 16, characterized in that said inductor has small values of form factor (ratio between a height along said revolution axis and an external diameter of said core) when adapted to specific constraints of low profile applications.

31. The inductor as claimed in claim 16, characterized in that said inductor has a low level of audible noise when supplied with AC currents at low frequencies in a range of DC to 1000 Hz and substantially no magnetically induced vibrations in said magnetic material thereby minimizing audible noise.

32. An inductor as claimed in claim 16 wherein said soft isotropic magnetic material is a composite material comprised of iron and resin.

33. A transformer as claimed in claim 1 wherein said soft isotropic magnetic material is a composite material comprised of iron and resin.

34. The transformer as claimed in claim 1 wherein said transformer is a polyphase transformer formed by stacking cores of each phase face to face or with separation airgaps.

35. The inductor as claimed in claim 16 wherein said inductor is a polyphase inductor formed by stacking cores of each phase face to face or with separation airgaps.

* * * * *

UNITED STATES PATENT AND TRADEMARK OFFICE

CERTIFICATE OF CORRECTION

PATENT NO. : 6,879,237 B1
APPLICATION NO. : 10/070750
DATED : April 12, 2005
INVENTOR(S) : Philippe Viarouge et al.

It is certified that error appears in the above-identified patent and that said Letters Patent is hereby corrected as shown below:

On Title Page col. 1 Item (73)

"(73) Assignee: Electrotechnologies Selem Inc., Quebec, (CA)"

should read

--(73) Assignee: Quebec Metal Powders Limited, Quebec (CA)--.

Signed and Sealed this

Fifth Day of September, 2006

JON W. DUDAS
*Director of the United States Patent and Trademark Office*